US008726873B2

(12) United States Patent
Beerens et al.

(10) Patent No.: US 8,726,873 B2
(45) Date of Patent: May 20, 2014

(54) MOVEABLE VALVE SEALING BODY EXPOSED TO HOT GASES

(75) Inventors: Christoph Beerens, Stuttgart (DE); Andreas Hoffmann, Renningen (DE); Christoph Luven, Stuttgart (DE)

(73) Assignee: Mahle International GmbH (DE)

( * ) Notice: Subject to any disclaimer, the term of this patent is extended or adjusted under 35 U.S.C. 154(b) by 1047 days.

(21) Appl. No.: 12/609,593

(22) Filed: Oct. 30, 2009

(65) Prior Publication Data

US 2010/0108012 A1 May 6, 2010

(30) Foreign Application Priority Data

Oct. 31, 2008 (DE) ..... 10 2008 054 266

(51) Int. Cl.
*F01L 3/02* (2006.01)

(52) U.S. Cl.
USPC ..... 123/188.3

(58) Field of Classification Search
USPC ..... 123/41.34, 41.41, 79 R, 188.2, 188.3, 123/188.6, 188.8–188.9, 188.11; 427/456; 29/888.06
See application file for complete search history.

(56) References Cited

U.S. PATENT DOCUMENTS

| | | | | | |
|---|---|---|---|---|---|
| 1,784,640 | A | * | 12/1930 | Noble | 420/501 |
| 2,881,750 | A | * | 4/1959 | Hanink | 123/188.3 |
| 2,893,349 | A | * | 7/1959 | Hanink | 118/63 |
| 4,554,898 | A | * | 11/1985 | Yamada et al. | 123/188.3 |
| 4,811,701 | A | * | 3/1989 | Buhl et al. | 123/188.3 |
| 5,543,029 | A | * | 8/1996 | Kenmoku et al. | 205/109 |
| 6,017,591 | A | | 1/2000 | Popoola | |
| 2006/0093736 | A1 | * | 5/2006 | Raybould et al. | 427/180 |
| 2007/0240668 | A1 | * | 10/2007 | Burton et al. | 123/188.3 |

FOREIGN PATENT DOCUMENTS

| | | | |
|---|---|---|---|
| DE | 367003 | C | 1/1923 |
| DE | 10055109 | | 5/2002 |
| DE | 69709530 | | 11/2002 |
| DE | 102006053550 | | 5/2008 |
| DE | 102007051374 | | 4/2009 |
| DE | 102007052800 | B3 | 5/2009 |
| EP | 0864730 | A1 | 9/1998 |
| EP | 1353045 | | 10/2003 |

(Continued)

OTHER PUBLICATIONS

English abstract for WO-03089768 corresponding to EP-1497538. (1 page).
English abstract of WO-2009056239 corresponding to DE-102007052800. (2 pages).

(Continued)

*Primary Examiner* — Hung Q Nguyen
(74) *Attorney, Agent, or Firm* — Rader, Fishman & Grauer PLLC

(57) ABSTRACT

A moveable valve sealing body, especially a valve sealing body of a gas exchange valve of an internal combustion engine, exposed to hot gases and comprising a sealing area that can be applied to a valve seat ring, enabling good heat dissipation outside an oil-lubricated guiding means connected to the sealing body. For this purpose, such a sealing body is characterized in that at least one surface region of the sealing body, which region being exposed to the hot gases, up to maximally directly on the sealing region of this sealing body, is composed respectively of at least one first and one second material (1, 2), wherein the second material (2) overlaps the first material (1) in an externally heat-conducting manner and furthermore has a greater heat conductivity than the first material (1). The second material (2) is applied by means of a thermal spraying method.

20 Claims, 1 Drawing Sheet

(56) References Cited

FOREIGN PATENT DOCUMENTS

Figure 1:
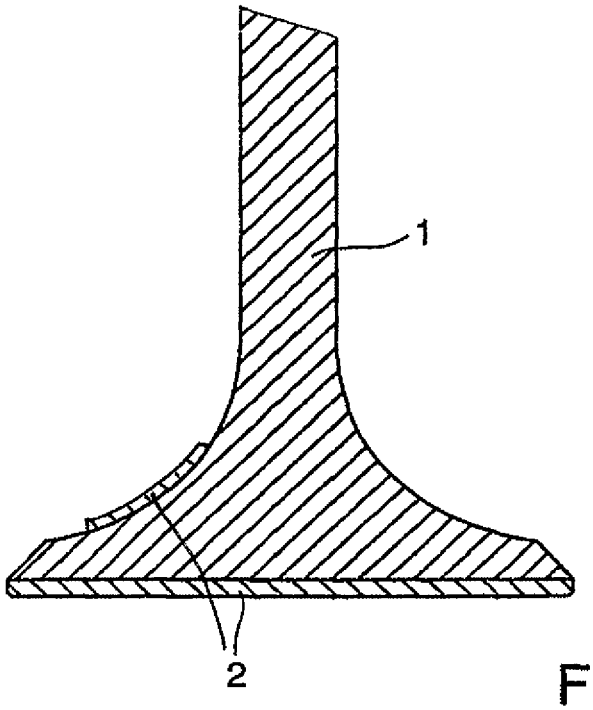

| | | | |
|---|---|---|---|
| EP | 1497538 | A1 | 1/2005 |
| JP | 63-150405 | | 6/1988 |
| JP | 1-96407 | | 4/1989 |
| JP | 3-129764 | U | 12/1991 |
| JP | 4-311611 | | 11/1992 |
| JP | 2003-278597 | A | 10/2003 |
| JP | 2003-307105 | A | 10/2003 |

OTHER PUBLICATIONS

English abstract for DE-102007051374.
English abstract for DE102006053550.
English abstract DE-10055109.
English abstract for EP-1353045.
English abstract for JP2003-307105.
English abstract for JP2003-278597.
English translation of Japanese Office Action for JP-2009-252082.
English abstract for JP4-311611.

* cited by examiner

MOVEABLE VALVE SEALING BODY EXPOSED TO HOT GASES

CROSS-REFERENCES TO RELATED APPLICATION

This application claims priority to German patent application DE 10 2008 054 266.0 filed on Oct. 31, 2008, which is hereby incorporated by reference in its entirety.

The invention relates to a moveable valve sealing body exposed to hot gases, especially a sealing body of a gas-exchange valve of an internal combustion engine, according to the preamble of claim 1.

In sealing bodies of gas-exchange valves of an internal combustion engine, it is recognised to configure the sealing body out of an interiorly positioned base material, which is provided on the exterior with an insulation material, at least in partial regions of the surfaces that are exposed to the hot combustion gases.

A sealing body of the generic type in question is, for example, disclosed in document DE 367 003 A1, in which a valve disc is covered by a layer of metal that conducts heat well. The cross-section of the covering is thin in the middle of the valve disc, corresponding to a high temperature gradient, and increasingly becomes thicker toward the edge in such a manner that a necessary discharge cross-section can always be available for the heat to be dissipated.

The present invention addresses the problem of providing for a sealing body of the generic type in question an improved or at least a different embodiment that is characterised in particular by a uniform heat distribution during operation as well as by being easy to manufacture.

This problem is solved according to the invention by the subject matter of independent claim 1. Advantageous embodiments are the subject matter of the dependent claims.

The invention is based on the general concept of applying a metallic covering, heretofore already known with regard to sealing bodies and furthermore having a greater degree of heat conductivity in comparison to a base body, onto the base body now by means of a spraying method, that is to say onto a first material, wherein thermal insulation is no longer provided between the first and the second material, in such a manner that the second material, which conducts heat well, can dissipate the heat both in the edge region of a valve disc of the sealing body as well as from this edge region into a valve seat and into a valve body itself as well, in such a manner that it can be heated relatively uniformly without temperature gradients arising that are too high and highly stressful. Conventional surface coating methods are subsumed under a thermal spraying method in which filler materials, the so-called spray adjunct, that are fused, vitrified, or melted in a gas flow within or outside a spray burner are accelerated in the form of spray particles and are thrown onto the surface of the material to be coated. Vitrification does not occur on the surface to be coated that is thermally stressed only to a minimal degree. A layer formation takes place in so far as upon striking the surface, the spray particles more or less flatten independent of the process and the material, preferentially remain adhered by means of mechanical clamping, and furthermore form the spray layer by means of coatings. Particularly advantageous in such thermal spraying methods is the low degree of porosity of the spray layers, the favourable connection of the same to a base material, the lack of cracks, and a relatively homogeneous microstructure. The layer properties obtained can largely be determined by the temperature and the speed of the spray particles at the time of their contact with the material to be coated. An electric arc, plasma jets, laser beams or preheated gases (for example cold gas spraying, HVOF), for example, serve as the energy transfer medium for the vitrification or melting of the spray filler material. Relating to the valve body, the second material in one of the hot gases is on the most highly exposed surface region of the sealing body up to maximally directly on the sealing region of the sealing body and is thereby in a position both to rapidly dissipate the high component temperatures arising during the operation of the internal combustion engine into the valve seat and furthermore to achieve a comparably uniform heating of the valve body. The second material that is good at conducting heat extends in particular into those regions in which the sealing body contacts the valve seat when the valve is closed. However, preferably no second material is provided on a contact location between the valve body and the valve seat since owing to its high degree of heat conductivity, said material often has only a moderate resistance to wear and tear and would otherwise be heavily worn down in this region in particular. The first material of the sealing body, that is to say the base material, is selected largely on the basis of resistance.

In an advantageous development of the solution according to the invention, the second material is applied on the sealing body by means of a cold gas spraying method. In cold gas spraying, a coating material in powder form is applied onto the carrier material (substrate) with a very high velocity for which a process gas, which is heated to a few hundred degrees ° C., is accelerated to supersonic velocity by expansion in a Laval nozzle, subsequent to which the powder particles are injected into the gas stream. These injected spray particles are accelerated to such a high velocity that, in contrast to other thermal spraying methods, they form upon impact with the substrate a dense and at the same time a firmly adhering layer also without prior vitrification or melting. Generally, a cost-effective and strongly adhering surface coating can be achieved with cold gas spraying.

Additional important features and advantages of the invention can be found in the dependent claims, in the drawings, and in the pertinent description of the figures with reference to the drawings.

It is understood that the features described above and those to be described in what follows can be used not only in the particular cited combination, but also in other combinations or independently without departing from the scope of the present invention.

Preferred embodiments of the invention are shown in the drawings and are described in more detail in the following description, the same reference numerals referring to components which are the same or functionally the same or similar.

It is schematically shown in

Figure 2:
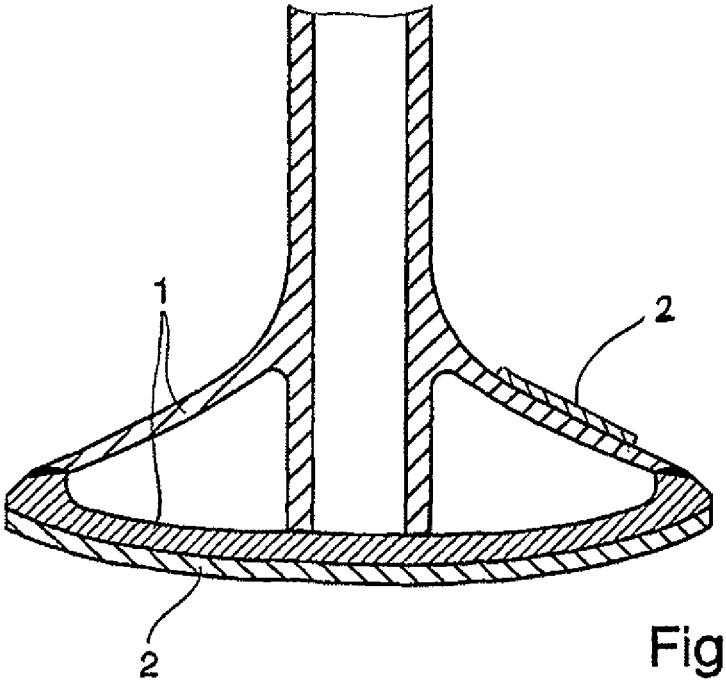

FIG. 1 a valve disc with adjacent valve stem of a gas-exchange valve of an internal combustion engine having a valve disc with solid material in the radial external region, FIG. 2 a valve disc with adjacent valve stem, wherein in contrast to the embodiment in FIG. 1, a valve disc is present that is hollow in the radial external region.

Corresponding to FIGS. 1 and 2, a respectively shown valve of an internal combustion engine has a first material 1 that serves as a base material and a second material 2, which is exposed to the hot combustion gases of a combustion chamber of the internal combustion engine, having a comparably greater heat conductivity. The second material 2, which has a greater heat conductivity with regard to the first material 1, extends radially outward maximally to directly that region in which the valve disc abuts the associated valve seat when the valve is closed. Such a valve seat is not shown for reasons of clarity.

According to the representation, the maximal radial extension of the second material 2 is shown.

With respect to both of the embodiments shown, the second material 2 that has the greater heat conductivity can extend over the radial, outer edges of the valve disc in the direction of the valve stem, that region of the valve disc that directly contacts the valve seat remaining omitted, however, owing to reasons of wear and tear. According to the invention, the second material 2 is applied by means of a thermal spraying method. Such a thermal spraying method can, for example, be a molten bath spraying, an arc spraying, a plasma spraying, a flame spraying, a detonation spraying, a cold gas spraying or a laser spraying. Especially preferred is the cold gas spraying method in which the second material 2, that is to say the coating material, is applied in a powder form onto the first material 1, that is to say the carrier material, at a very high velocity. For this purpose, a process gas, for example nitrogen or another inert gas, heated to a few hundred degrees ° C. is accelerated to super sonic velocity by expansion in a Laval nozzle and subsequently the powder particles are injected into the gas stream and are then accelerated to such a high degree that, in contrast to other thermal spraying methods, they form a solid and strongly adhering layer upon impact on the first material without prior vitrification or melting.

An alternative thermal spraying method is, for example, the plasma spraying method in which an anode and up to three cathodes are separated by a narrow gap on a plasma torch. By means of direct current voltage, an arc is generated between anode and cathode, wherein the gas flowing through the plasma torch is conducted through the arc and is thereby ionised. The dissociation, or subsequent ionisation, generates a highly-heated, electrically-conductive gas composed of positive ions and electrons, in which gas the coating material, here that is to say the second material 2, is injected and immediately melted through the high plasma temperature. The plasma gas stream carries the coating material along and throws it on the first material 1. There is conventionally no (heat) insulating layer provided between the first material 1 and the second material 2, which means that the second material 2, which is good at conducting heat, can, on the one hand, dissipate high temperatures that arise during the combustion process on an edge region and thus over the valve seat and, on the other hand, uniformly introduce said temperatures into the first material 1. To improve the connection between the second material 2 and the first material 1, an adhesion promoter can, however, be arranged therebetween, which surface has aluminium and/or nickel, for example. The adhesion promoter or the adhesive layer can be up to 100 μm thick, as can likewise, for example, a corrosion protection layer with which the second material 2 is coated. Such a corrosion protection layer can contain nickel, in particular.

In comparison, the second material 2 is conventionally configured of a material that conducts heat well, for example copper having a degree of purity of greater than 99% or silver. The layer thickness of the second material 2 is between 0.2 and 1.0 mm.

The invention claimed is:

1. A valve sealing body comprising:

a valve stem;

a valve head including a sealing seat region configured for interacting with a port for sealing the port, and a main surface region adjoining the sealing seat region and located at an opposite side of the valve head from the valve stem; and a covering that is applied to the valve head by a cold gas spraying method such that at least the main surface region is covered by the covering, wherein the covering has a higher degree of heat conductivity than a base material of the valve head.

2. The valve sealing body of claim 1, wherein the covering also covers portions of the sealing seat region, except that any contact locations where the valve sealing body would contact the port when in a closed position are not covered by the covering.

3. The valve sealing body of claim 2, wherein the covering also covers portions of the valve head located on a side of the valve head opposite from the main surface region.

4. The valve sealing body of claim 2, wherein the covering comprises copper.

5. The valve sealing body of claim 1, wherein an adhesive layer is disposed between the valve head and the covering.

6. The valve sealing body of claim 5, wherein the adhesive layer comprises at least one of nickel and aluminum.

7. The valve sealing body of claim 5, wherein a thickness of the adhesive layer does not exceed 100 μm.

8. The valve sealing body of claim 1, wherein the covering also covers portions of the valve head located on a side of the valve head opposite from the main surface region.

9. The valve sealing body of claim 1, wherein the covering comprises copper.

10. The valve sealing body of claim 1, wherein a thickness of the covering is between 0.2 and 0.1 mm.

11. The valve sealing body of claim 1, wherein the covering is covered with at least a corrosion protection layer.

12. The valve sealing body of claim 11, wherein the corrosion protection layer comprises nickel and is no more than 100 μm thick.

13. The valve sealing body of claim 1, wherein the covering is configured to uniformly conduct heat into the valve head, including throughout a region extending from a center region of the valve head to the sealing seat region.

14. The valve sealing body of claim 1, wherein there is no insulating material on the main surface region of the valve head.

15. A method of manufacturing a valve sealing body comprising:

providing a valve sealing body having a valve stem, and a valve head including a sealing seat region configured for interacting with a port for sealing the port, and a main surface region adjoining the sealing seat region and located at an opposite side of the valve head from the valve stem; and applying a covering to the valve head by a cold gas spraying method such that at least the main surface region is covered by the covering, wherein the covering has a higher degree of heat conductivity than a base material of the valve head.

16. The method of claim 15, wherein the covering comprises copper.

17. The method of claim 15, wherein the cold gas spraying method comprises, in order:

accelerating a gas stream to supersonic velocity, injecting the covering material in powder form into the gas stream, and causing the covering material in the gas stream to impact the valve head, wherein the covering material is not vitrified or melted as part of the cold gas spraying method prior to impact with the valve sealing body.

18. A valve sealing body comprising:

a valve stem;

a valve head including:

a sealing seat region configured for interacting with a port for sealing the port, and a main surface region adjoining the sealing seat region and located at an opposite side of the valve head from the valve stem; and a copper covering that covers at least the main surface region, wherein the copper covering is configured to have structural characteristics of a copper covering applied to the valve head by a cold gas spraying method.

19. The valve sealing body of claim 18, wherein said structural characteristics of a copper covering applied to the valve head by a cold gas spraying method include:

greater homogeneity, less porosity, higher density, less oxidation, and higher heat conductivity than layers of copper applied by thermal spraying methods other than the cold gas spraying method.

20. The valve sealing body of claim 18, wherein the covering is configured to uniformly conduct heat into the valve head, including throughout a region extending from a center region of the valve head to the sealing seat region.

* * * * *